US012397974B2

(12) United States Patent
Aboabdo et al.

(10) Patent No.: US 12,397,974 B2
(45) Date of Patent: Aug. 26, 2025

(54) CHILD-RESISTANT CONTAINER

(71) Applicant: Chubby Gorilla, Inc., Fullerton, CA (US)

(72) Inventors: Ibrahiem H. Aboabdo, Yorba Linda, CA (US); Xingxin Huang, Hangzhou (CN); Yining Wang, Hangzhou (CN); Fengdun Zhang, Hangzhou (CN); Xing Gao, Hangzhou (CN)

(73) Assignee: Chubby Gorilla, Inc., Fullerton, CA (US)

( * ) Notice: Subject to any disclaimer, the term of this patent is extended or adjusted under 35 U.S.C. 154(b) by 0 days.

(21) Appl. No.: 18/572,673

(22) PCT Filed: Aug. 30, 2022

(86) PCT No.: PCT/US2022/042048
§ 371 (c)(1),
(2) Date: Dec. 20, 2023

(87) PCT Pub. No.: WO2023/034306
PCT Pub. Date: Mar. 9, 2023

(65) Prior Publication Data

US 2024/0336411 A1 Oct. 10, 2024

Related U.S. Application Data

(60) Provisional application No. 63/260,901, filed on Sep. 3, 2021.

(51) Int. Cl.
*B65D 50/06* (2006.01)

(52) U.S. Cl.
CPC ..... *B65D 50/061* (2013.01)

(58) Field of Classification Search
CPC ..... B65D 50/061; B65D 50/043; B65D 2543/00092
See application file for complete search history.

(56) References Cited

U.S. PATENT DOCUMENTS 4,071,156 A * 1/1978 Lowe ..... B65D 41/48 215/256
4,573,598 A * 3/1986 Perry ..... B65D 50/061 215/256
4,768,682 A 9/1988 Friedrich
(Continued)

FOREIGN PATENT DOCUMENTS

JP 4737351 B2 7/2011

OTHER PUBLICATIONS

International Search Report for Application No. PCT/US2022/042048, dated Dec. 16, 2022.

*Primary Examiner* — Shawn M Braden
(74) *Attorney, Agent, or Firm* — Knobbe, Martens, Olson & Bear, LLP

(57) ABSTRACT

A child-resistant container that includes a cap and a bottle portion. The cap includes several inner engagement features protruding radially inwardly and the finish of the bottle portion includes a protrusion disposed about the opening with an overhanging ledge. Slots in the ledge correspond to the engagement features. In one particular embodiment, the cap includes two different length circumferential engagement features and two triangular engagement features.

6 Claims, 7 Drawing Sheets

(56) References Cited

U.S. PATENT DOCUMENTS

| | | | | |
|---|---|---|---|---|
| 5,317,796 | A * | 6/1994 | Hunter | B65D 50/061 29/434 |
| 7,510,094 | B1 * | 3/2009 | Willis | B65D 50/043 215/218 |
| 2010/0133225 | A1 | 6/2010 | Lewis | |
| 2014/0061149 | A1 * | 3/2014 | Goldberg | B65D 50/061 215/208 |
| 2015/0014270 | A1 | 1/2015 | Biesecker et al. | |
| 2019/0241330 | A1 | 8/2019 | Stoneberg et al. | |
| 2023/0211928 | A1 * | 7/2023 | Sanchez | B65D 50/04 215/217 |

* cited by examiner

CHILD-RESISTANT CONTAINER

INCORPORATION BY REFERENCE

This application claims priority to U.S. Provisional Patent Application 63/260,901 filed on Sep. 3, 2021, which is hereby incorporated by reference herein in its entirety for all purposes. Any and all applications for which a foreign or domestic priority claim is identified in the PCT Request as filed with the present application are hereby incorporated by reference.

BACKGROUND

Field

This disclosure generally relates to devices and systems for preventing access to the contents of a container by one or more mechanisms, commonly referred to as child-resistant or child-proof containers.

Description of the Related Art

Many types of containers are designed to prevent access to the contents thereof by children or others. Commonly, a bottle includes a cap that is difficult to remove to open the bottle portion of the container if the person manipulating the cap doesn't understand the mechanism for removing the cap. However, removal of the cap should not be too difficult and the mechanism should not be too complex or delicate to prevent simply breaking any of the child-resistant features of the cap. Accordingly, improvements are needed for existing child-resistant cap features.

SUMMARY

A first aspect of the disclosure includes a child-resistant container. The child-resistant container includes a cap having an upper surface and a wall having an interior surface. The interior surface of the wall includes a first engagement feature, a second engagement feature, a third engagement feature, and a fourth engagement feature protruding radially inwardly. A bottle portion includes an outer surface and a finish having an opening into the container defined by a rim, the finish includes a tapered protrusion disposed about the rim with a ledge on an underside thereof. The tapered protrusion has gaps in the ledge including a first slot corresponding to the first engagement feature, a second slot corresponding to the second engagement feature, a third slot corresponding to the third engagement feature, and a fourth slot corresponding to the fourth engagement feature. The first, second, third, and fourth engagement features each include an upper horizontal surface. In a locked configuration, the cap is attached to the finish with the wall disposed radially outwardly around the tapered protrusion and the first, second, third, and fourth engagement features are aligned below the ledge of the tapered protrusion such that the cap is locked against removal from the finish in a vertical direction by engagement of the horizontal surfaces of the first, second, third, and fourth engagement features with the ledge. In an unlocked configuration, the first, second, third, and fourth engagement features are aligned vertically with the corresponding first, second, third, and fourth slots such that the cap can be removed from the finish vertically with the first, second, third, and fourth engagement features passing through the gaps in the ledge. The first engagement feature has a first thickness in a radial direction and a first length in a circumferential direction, and the first slot has the first thickness and the first length. The second engagement feature has a second thickness in the radial direction and a second length in the circumferential direction. The first thickness is equivalent to the second thickness. The first length is less than the second length. The second slot has the second thickness and the second length. The first engagement feature is disposed opposite the second engagement feature. The third engagement feature has a first triangular shape when viewed normal to the vertical direction. The third slot having the first triangular shape. The fourth engagement feature has a second triangular shape when viewed normal to the vertical direction. The fourth slot having the first triangular shape. The third engagement feature is disposed opposite the fourth engagement feature.

According to a second aspect, a child-resistant container includes a cap including a wall having an interior surface. The interior surface of the wall includes a first engagement feature protruding radially inwardly. A bottle portion including a finish has an opening into the container. The finish includes a protrusion disposed about the opening with an overhanging ledge, a first slot corresponding to the first engagement feature disposed in the ledge. In a locked configuration, the cap is attached to the finish with the wall disposed radially outwardly around the finish and the first engagement feature is aligned below the ledge of the protrusion such that the cap is locked against removal from the finish in a vertical direction by engagement of the first engagement feature with the ledge. In an unlocked configuration, the first engagement feature is aligned vertically with the first slot such that the cap can be removed from the finish vertically with the first engagement feature passing through the first slot in the ledge.

According to another aspect, the protrusion includes an outer tapered surface. According to another aspect, a second slot is disposed in the ledge corresponding to a second engagement feature on the interior surface of the cap. According to another aspect, in the locked configuration, the second engagement feature is aligned below the ledge of the protrusion such that the cap is locked against removal from the finish in the vertical direction by engagement of the second engagement feature with the ledge.

According to another aspect, in the unlocked configuration, the second engagement feature is aligned vertically with the second slot such that the cap can be removed from the finish vertically with the second engagement feature passing through the second slot in the ledge. According to another aspect, a third slot is disposed in the ledge corresponding to a third engagement feature on the interior surface of the cap. According to another aspect, in the locked configuration, the third engagement feature is aligned below the ledge of the protrusion such that the cap is locked against removal from the finish in the vertical direction by engagement of the third engagement feature with the ledge. According to another aspect, in the unlocked configuration, the third engagement feature is aligned vertically with the third slot such that the cap can be removed from the finish vertically with the third engagement feature passing through the third slot in the ledge. According to another aspect, a fourth slot is disposed in the ledge corresponding to a fourth engagement feature on the interior surface of the cap. According to another aspect, in the locked configuration, the fourth engagement feature is aligned below the ledge of the protrusion such that the cap is locked against removal from the finish in the vertical direction by engagement of the fourth engagement feature with the ledge. In the unlocked configuration, the fourth engagement feature is aligned vertically with the fourth slot such that the cap can be removed from the finish vertically with the fourth engagement feature passing through the fourth slot in the ledge. According to another aspect, the first engagement feature has a first thickness in a radial direction and a first length in a circumferential direction, the first slot having the first thickness and the first length. According to another aspect, the second engagement feature has a second thickness in the radial direction and a second length in the circumferential direction, the first thickness being equivalent to the second thickness, and the first length being less than the second length, the second slot having the second thickness and the second length. According to another aspect, the third engagement feature has a first triangular shape when viewed normal to the vertical direction, the third slot having the first triangular shape. According to another aspect, the fourth engagement feature has a second triangular shape when viewed normal to the vertical direction, the fourth slot having the first triangular shape. According to another aspect, the first engagement feature is disposed opposite the second engagement feature. According to another aspect, the third engagement feature is disposed opposite the fourth engagement feature. According to another aspect, the first, second, third, and fourth engagement features each include an upper horizontal surface configured to engage with the ledge in the locked configuration.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein

BRIEF DESCRIPTION OF THE DRAWINGS

Various examples are depicted in the accompanying drawings for illustrative purposes, and should in no way be interpreted as limiting the scope of the examples. Various features of different disclosed examples can be combined to form additional examples, which are part of this disclosure.

DETAILED DESCRIPTION

Figure 1A:
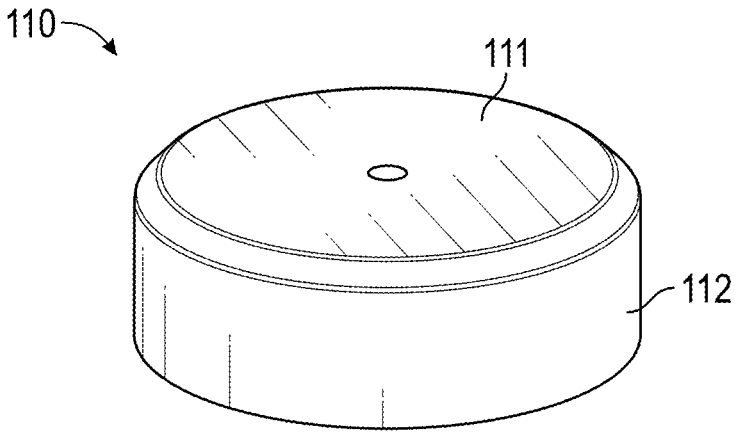
FIG. 1A shows a perspective view of a cap designed for a child-resistant container.
Figure 1B:
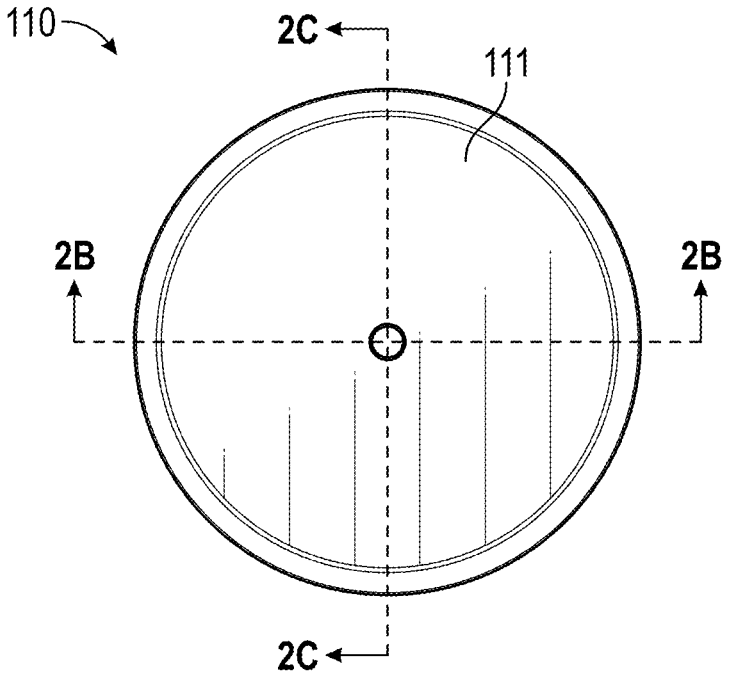
FIG. 1B shows a top view of the cap.
Figure 1C:
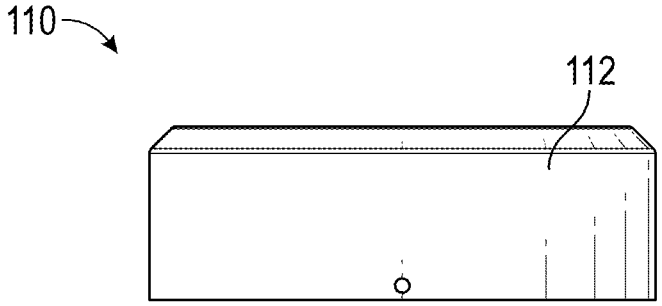
FIG. 1C shows a side view of the cap.

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features of the illustrated examples can be modified, combined, removed, and/or substituted as will be apparent to those of ordinary skill in the art upon consideration of the principles disclosed herein.

Various types of child-resistant containers are commonly available. A common design is a cap that is detachable from a finish portion of bottle or other type of container. The present disclosure is primarily directed to a container assembly that includes child-resistant features that are easy to manufacture and structurally reliable. In addition, the cap can be easily opened by an adult or other person with knowledge of the mechanism for removing the cap from the bottle but is also likely too difficult for most children to open.

FIGS. 1A-2C show a cap 110 assembly for a container with child-resistant features. The cap 110 can include an outer wall 112 and an upper wall 111. The outer wall 112, can have a generally circular or circular profile, although this is not required. The outer wall 112 can extend downwardly from the upper wall 111. The upper wall 111 can enclose an upper end of the outer wall 112. The outer wall 112 can be a generally cylindrical portion and/or include gripping features on an outer surface thereof.

An interior side of the outer wall 112 can include one or more engagement features that engage with a bottle portion discussed below. The engagement features can include a first engagement feature 121, a second engagement feature 122, a third engagement feature 123, and/or a fourth engagement feature 124. The number and positioning of the engagement features can be varied depending on the particular design. The first engagement feature 121 can be disposed opposite the second engagement feature 122. The third engagement feature 123 can be disposed opposite the fourth engagement feature 124. The first, second, third, and fourth engagement features can be located around the circumference of the interior surface of the outer wall 112 (e.g., at equally spaced 90° positions). The engagement features can extend radially inwardly towards a center of the outer wall 112. The engagement features can project from the interior wall of the outer wall 112. One or more of the engagement features can include an upper horizontal surface that extends perpendicular to the interior surface of the outer wall 112. The engagement features can be spaced upwardly above a lower rim of the outer wall 112.

The first engagement feature 121 can have a thickness in a radial direction relative to the outer wall 112. The first engagement feature 121 can include a circumferential length in a circumferential direction around the interior surface of the outer wall 112. The first engagement feature 121 can be generally block shaped. The second engagement feature 122 can have a thickness in the radial direction and a length in the circumferential direction. The thickness of the first engagement feature 121 can be equivalent to the thickness of the second engagement feature 122. The circumferential length of the first engagement feature 121 can be less than the length of the engagement feature 122.

Figure 2A:
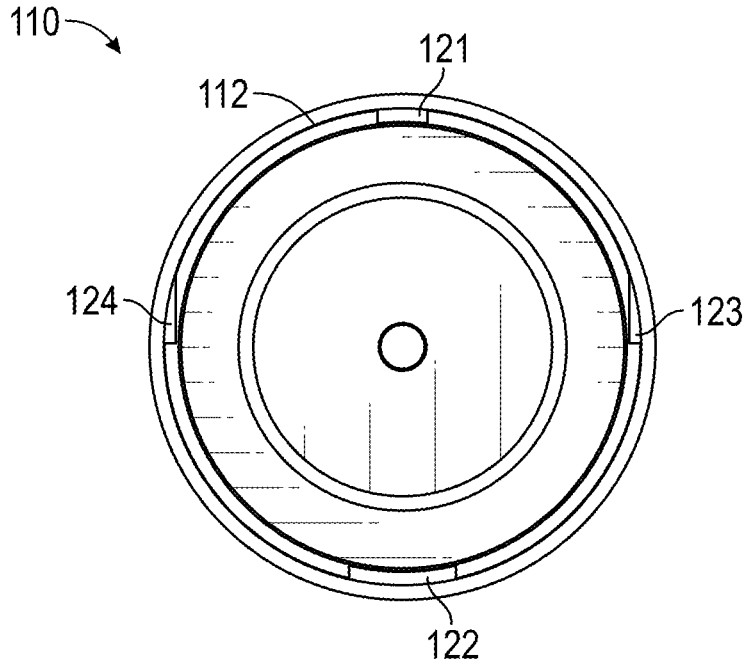
FIG. 2A shows a bottom view of the cap.
Figure 2B:
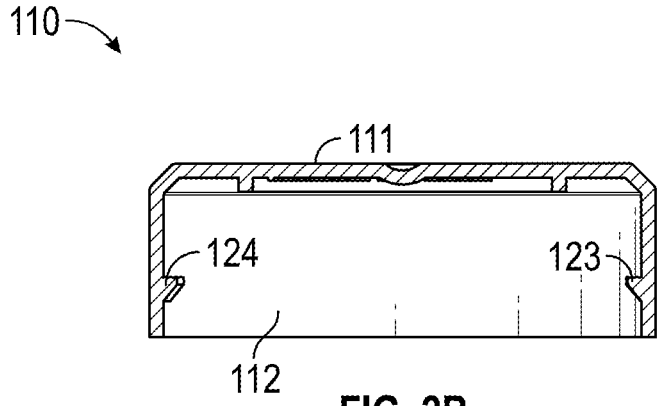
FIG. 2B shows a section view taken along the line 2B-2B in FIG. 1B.
Figure 2C:
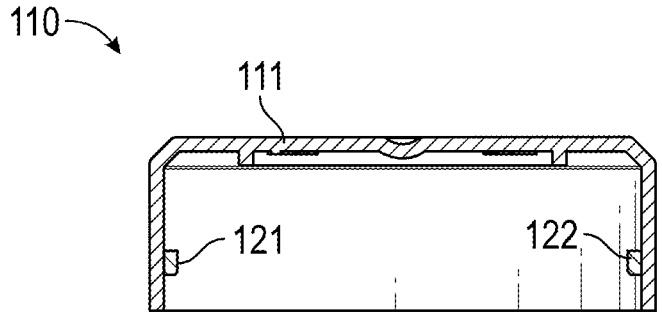
FIG. 2C shows a section view taken along the line 2C-2C in FIG. 1B.
Figure 3C:
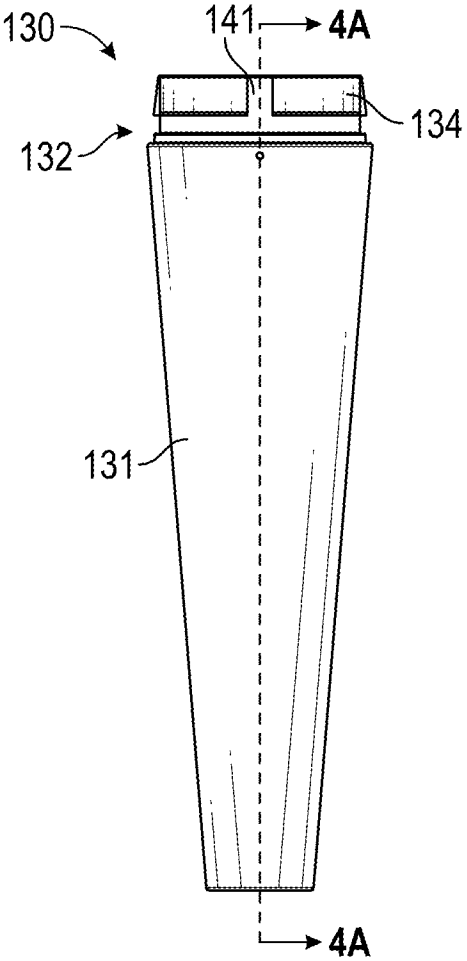
FIG. 3C shows a second side view of the bottle.
Figure 3B:
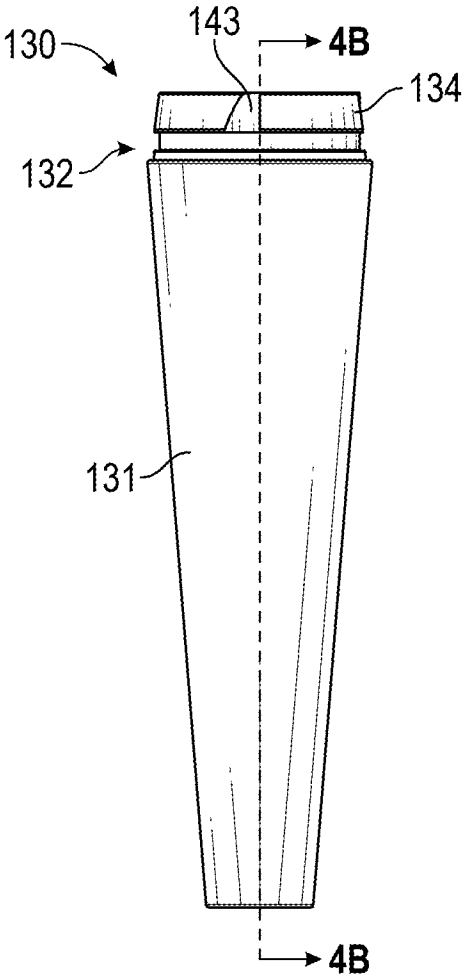
FIG. 3B shows a first side view of the bottle.
Figure 3A:
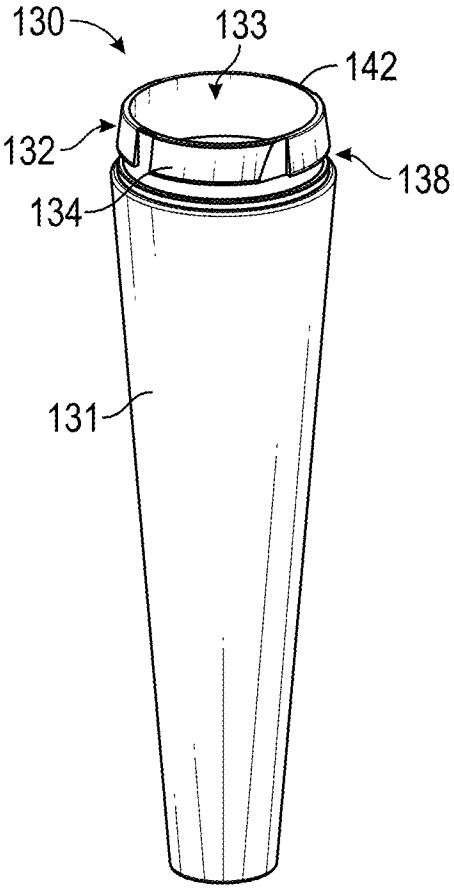
FIG. 3A shows a perspective view of a bottle of the child-resistant container.
Figure 4B:
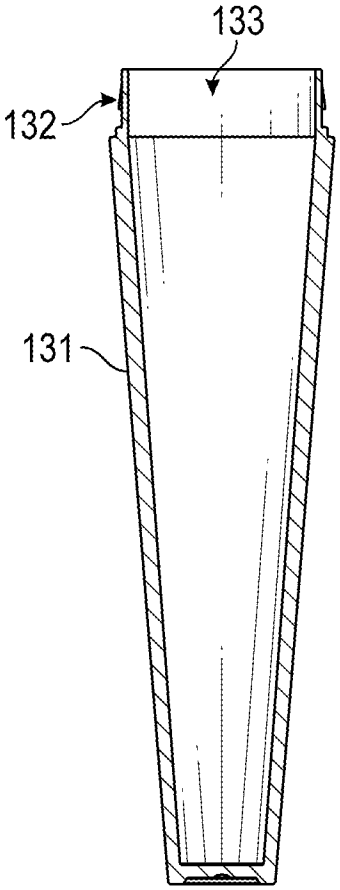
FIG. 4B shows a section view of the bottle taken along the line 4B-4B in FIG. 3B.
Figure 4A:
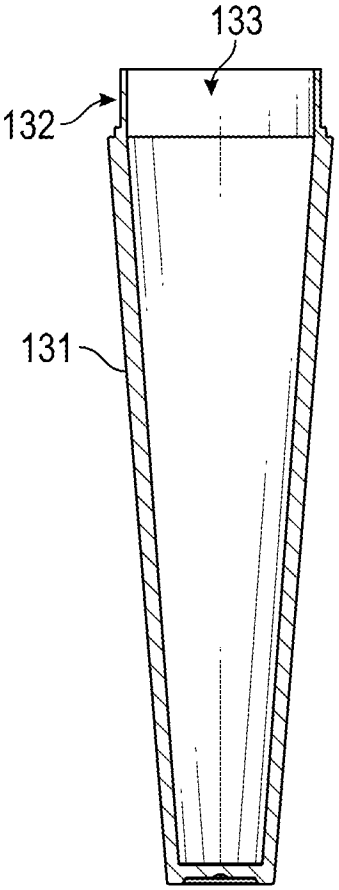
FIG. 4A shows a section view of the bottle taken along the line 4A-4A in FIG. 3C.
Figure 3D:
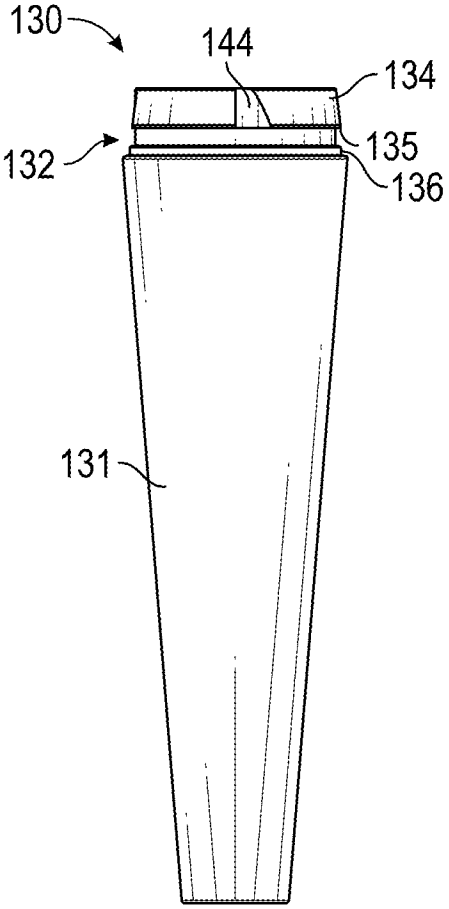
FIG. 3D shows a third side view of the bottle.

The third engagement feature 123 can have a triangular shape when viewed normal to the vertical direction as shown in FIG. 2A. The triangular shape can be a right triangle or other triangular shape. The fourth engagement feature 124 can have a triangular shape. The triangular shape can be a right triangle or other triangular shape. The triangular shape of a third engagement feature 123 can be a mere image of the triangular shape of the fourth engagement feature 124. Optionally an lower face of the third and fourth engagement features 123, 124 can be chamfered as shown in FIG. 2B. A length of the third engagement feature 123 in the circumferential direction can be equivalent less than or greater than a length of the fourth engagement feature 124 in the circumferential direction. Optionally, the length of the third engagement feature 123 and/or the fourth engagement feature 124 can be greater than the length of the first engagement feature 121 and less than the length of the second engagement feature 122.

FIGS. 3A-5 shows a bottle 130 or a container portion of the container assembly. The bottle 130 can include an outer wall 131 enclosing an interior space. The outer wall 131 can have various shapes and sizes. As illustrated, the outer wall 131 can include a generally frustro-conical shape terminating in a bottom wall.

An upper end of the outer wall 131 can include a finish portion 132. The finish portion 132 can include an opening 133 into the interior of the outer wall 131. The opening 133 can be defined by an upper rim of the finish 132. The finish 132 can include a tapered protrusion 134. The tapered protrusion 134 can extend around a circumference of the opening 133. The tapered protrusion 134 can have a smaller diameter at the rim of the finish portion of 132 that gets broader as the tapered protrusion 134 extends downwardly. A groove 138 can be disposed between the tapered protrusion 134 and a top surface of the container wall 131 (e.g., at the base of the finish. A height of the groove 138 can be sized to receive the engagement features of the cap 110 as described further below.

The tapered protrusion 134 can include a lower ledge. The lower ledge can be disposed generally perpendicularly with a longitudinal access of the bottle 130 (e.g., facing the groove 138). The ledge can be generally horizontal. The ledge can extend around a circumference of the tapered protrusion 134.

Figure 5:
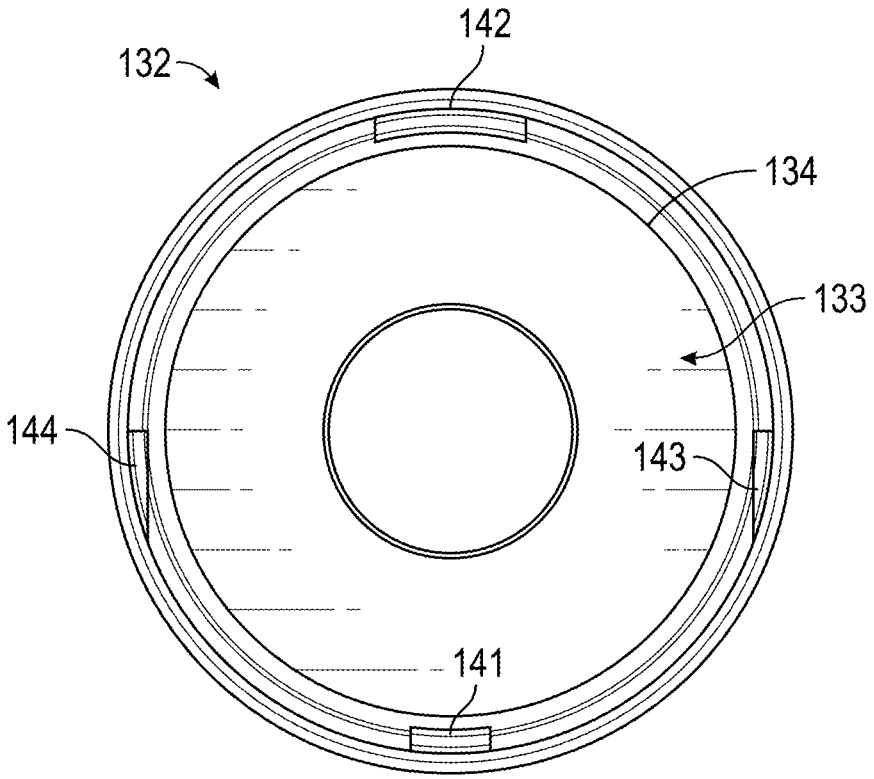
FIG. 5 shows a top view of a finish portion of the bottle.

The ledge 139 can be broken by one or more vertical slots therein. The slots can extend entirely through the tapered protrusion 134 to the groove 138 and extend upwardly to the rim of the opening 133. The vertical slots can include a first slot 141, a second slot 142, a third slot 143, and a fourth slot 144. The first slot 141 can have a length in a circumferential direction of the finish portion 132. The length of the first slot 141 can correspond to the length of the first engagement feature 121. A depth of the first slot 141 in the radial direction can correspond to the width of the first engagement feature of 121. The second slot 142 can generally correspond to the second engagement feature 122. The second slot 142 can have a length in the circumferential direction and a depth in the radial direction that correspond to the length and the width of the second engagement feature 122. The third slot, 143 can generally correspond to the third engagement feature 143. The third slot can have a generally triangular shape when viewed from a top view or a view normal to the vertical direction as shown in FIG. 5. A length and depth of the third slot 143 can correspond to the length and width of the third engagement feature 123. The third slot 143 can have a triangular shape. The fourth slot 144 can generally correspond to the fourth engagement feature 124. A length and a depth of the fourth slot 144 can correspond to the length and width of the fourth engagement feature 124. The fourth slot 144 can have a triangular shape. The first, second, third and fourth slots can be disposed about the circumference of the tapered protrusion 134 so as to correspond with the positions of the first, second, third, and fourth engagement features respectively.

Figure 6C:
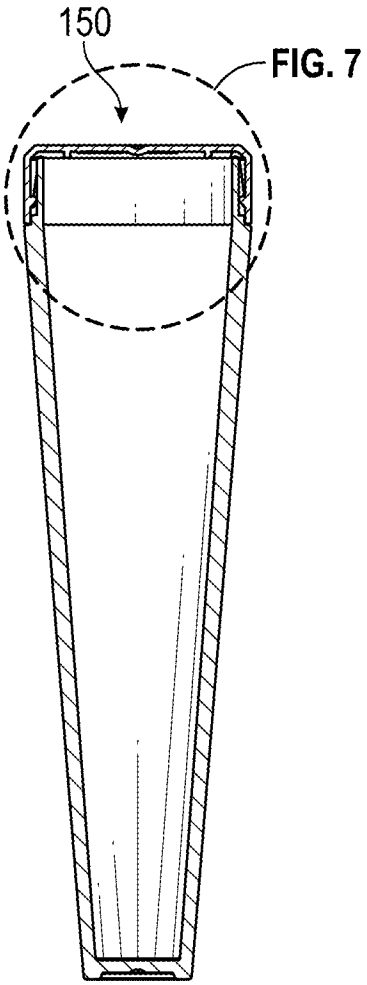
FIG. 6C shows a section view taken along the line 6C-6C in FIG. 6B.
Figure 6B:
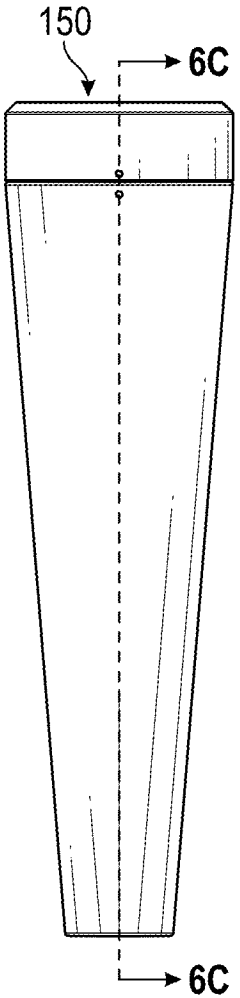
FIG. 6B shows a side view of the assembled container.
Figure 6A:
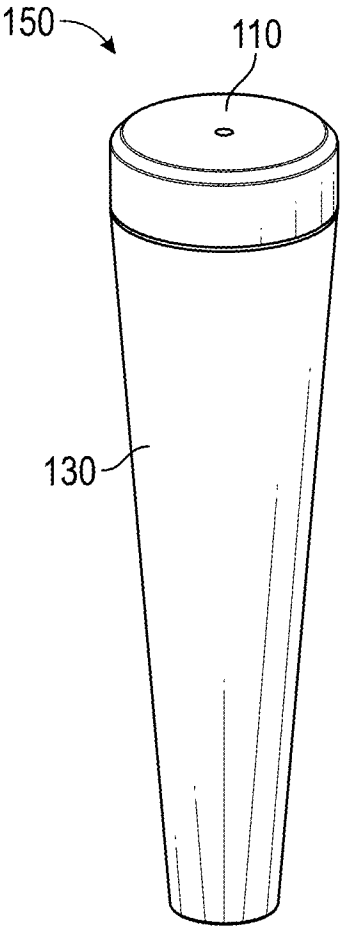
FIG. 6A shows a perspective view of the assembled container including the cap and the bottle.
Figure 7:
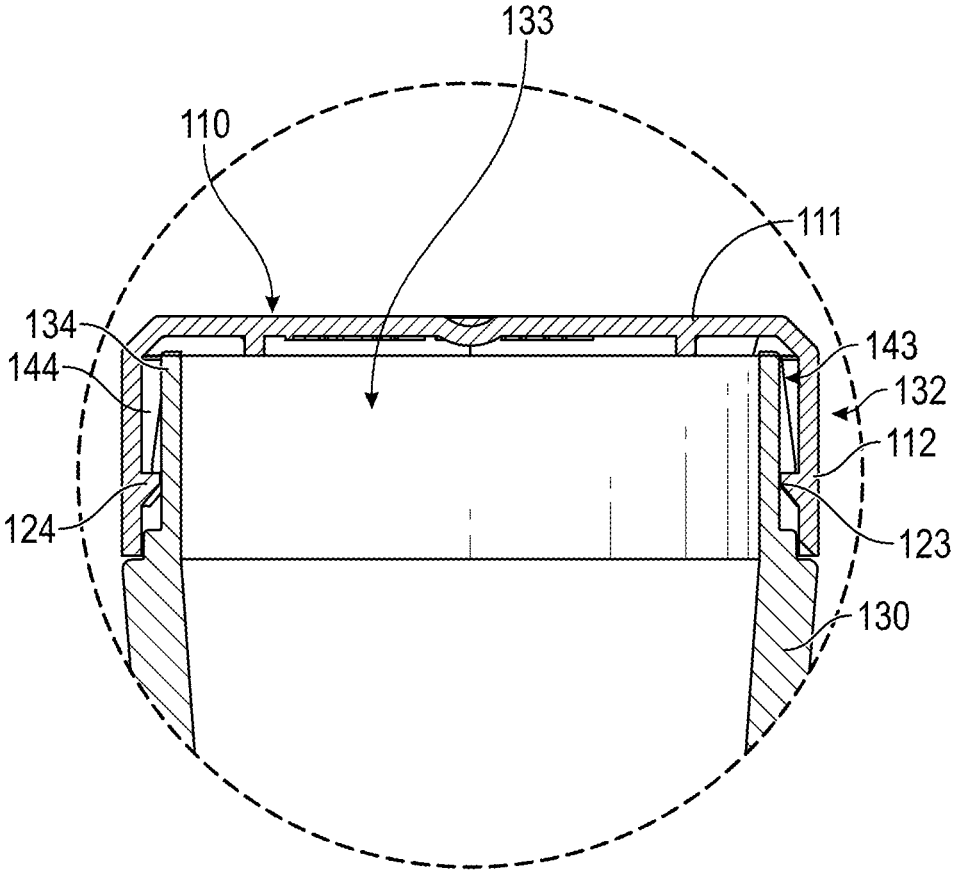
FIG. 7 shows a detailed view of FIG. 6C.

As shown in FIGS. 6A-7 the cap 110 can be assembled with the finish portion 132 of the container 130 to form the assembled container 150. The cap 110 can be assembled over the protrusion 134 such that the engagement features of the cap 110 are within the slot 128. To assembly the cap 110, the engagement features can either be forced downward over the tapered protrusion 134 into the groove 138 of the engagement features can be aligned with the respective slots and passed through said slots into the groove 138. The upper horizontal surfaces of the engagement features can engage with the ledge of the protrusion 134.

As assembled, the engagement features can be disposed within the groove 138. The cap 110 can be rotatable relative to the bottle 130. Accordingly, the slot extends around the circumference of the finish portion 132 so that the rotation of the cap 110 is enabled without interference from the engagement features. In a locked configuration, the engagement features of the cap 110 are either not aligned at all with the slots that are within the tapered protrusion 134 or they are aligned with non-corresponding slots. One or more of the engagement features may be unable to pass vertically through the non-corresponding slots. This locked configuration can prevent the cap 110 from being removed from the finished 132. The mechanical engagement between the engagement features and the ledge can prevent the removal of the cap 110 by a child.

The cap 110 can be rotated into a unlocked configuration with the corresponding engagement features aligned with the corresponding slots in the ledge. In the unlocked configuration, a vertical force on the cap 110 relative to the bottle 130 can enable the engagement features to pass upwardly though the corresponding slots for removal of the cap 110. Optionally, the cap 110 and/or the bottle 130 can include markings that indicate a correct alignment for removal and/or replacement of the cap 110.

The cap 110 can be reattached with the finished 132 of the bottle 130. This can be accomplished either by aligning the engagement features with the corresponding slots or forcing the engagement features over the tapered protrusion 134 and into the groove 138. After assembling the cap 110 with the finish 132, the cap 110 can be rotated into the locked configuration to misalign the engagement features with the corresponding slots.

Certain Terminology

Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

SUMMARY

Several illustrative examples of child-resistant containers have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of child-resistant containers and related methods have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

What is claimed is:

1. A child-resistant container, comprising:

a cap including an upper surface and a wall having an interior surface, the interior surface of the wall including a first engagement feature, a second engagement feature, a third engagement feature, and a fourth engagement feature protruding radially inwardly;

a bottle portion including an outer wall and a finish having an opening into the container defined by a rim, the finish including a tapered protrusion disposed about the rim with a ledge on an underside thereof, and the tapered protrusion having gaps in the ledge including a first slot corresponding to the first engagement feature, a second slot corresponding to the second engagement feature, a third slot corresponding to the third engagement feature, and a fourth slot corresponding to the fourth engagement feature, the first, second, third, and fourth engagement features each including an upper horizontal surface;

wherein in a locked configuration, the cap is attached to the finish with the wall disposed radially outwardly around the tapered protrusion and the first, second, third, and fourth engagement features are aligned below the ledge of the tapered protrusion such that the cap is locked against removal from the finish in a vertical direction by engagement of the horizontal surfaces of the first, second, third, and fourth engagement features with the ledge;

wherein in an unlocked configuration, the first, second, third, and fourth engagement features are aligned vertically with the corresponding first, second, third, and fourth slots such that the cap can be removed from the finish vertically with the first, second, third, and fourth engagement features passing through the gaps in the ledge;

wherein the first engagement feature has a first thickness in a radial direction and a first length in a circumferential direction, the first slot having the first thickness and the first length;

wherein the second engagement feature has a second thickness in the radial direction and a second length in the circumferential direction, the first thickness being equivalent to the second thickness, and the first length being less than the second length, the second slot having the second thickness and the second length;

wherein the first engagement feature is disposed opposite the second engagement feature;

wherein the third engagement feature has a first triangular shape when viewed normal to the vertical direction, the third slot having the first triangular shape;

wherein the fourth engagement feature has a second triangular shape when viewed normal to the vertical direction, the fourth slot having the first triangular shape;

wherein the third engagement feature is disposed opposite the fourth engagement feature.

2. A child-resistant container, comprising:

a cap including a wall having an interior surface, the interior surface of the wall including a first engagement feature protruding radially inwardly, a second engagement feature on the interior surface of the cap, a third engagement feature on the interior surface of the cap, and a fourth engagement feature on the interior surface of the cap;

a bottle portion including a finish having an opening into the container, the finish including a protrusion disposed about the opening with an overhanging ledge, a first slot corresponding to the first engagement feature disposed in the ledge, a second slot disposed in the ledge corresponding to the second engagement feature, a third slot disposed in the ledge corresponding to the third engagement feature, and a fourth slot disposed in the ledge corresponding to the fourth engagement feature, wherein the protrusion includes an outer tapered surface;

wherein in a locked configuration, the cap is attached to the finish with the wall disposed radially outwardly around the finish and the first engagement feature is aligned below the ledge of the protrusion such that the cap is locked against removal from the finish in a vertical direction by engagement of the first engagement feature with the ledge, wherein in the locked configuration, the second engagement feature is aligned below the ledge of the protrusion such that the cap is locked against removal from the finish in the vertical direction by engagement of the second engagement feature with the ledge, wherein in the locked configuration, the third engagement feature is aligned below the ledge of the protrusion such that the cap is locked against removal from the finish in the vertical direction by engagement of the third engagement feature with the ledge, wherein in the locked configuration, the fourth engagement feature is aligned below the ledge of the protrusion such that the cap is locked against removal from the finish in the vertical direction by engagement of the fourth engagement feature with the ledge;

wherein in an unlocked configuration, the first engagement feature is aligned vertically with the first slot such that the cap can be removed from the finish vertically with the first engagement feature passing through the first slot in the ledge, wherein in the unlocked configuration, the second engagement feature is aligned vertically with the second slot such that the cap can be removed from the finish vertically with the second engagement feature passing through the second slot in the ledge, wherein in the unlocked configuration, the third engagement feature is aligned vertically with the third slot such that the cap can be removed from the finish vertically with the third engagement feature passing through the third slot in the ledge, wherein in the unlocked configuration, the fourth engagement feature is aligned vertically with the fourth slot such that the cap can be removed from the finish vertically with the fourth engagement feature passing through the fourth slot in the ledge;

wherein the first engagement feature has a first thickness in a radial direction and a first length in a circumferential direction, the first slot having the first thickness and the first length, wherein the second engagement feature has a second thickness in the radial direction and a second length in the circumferential direction, the first thickness being equivalent to the second thickness, and the first length being less than the second length, the second slot having the second thickness and the second length, wherein the third engagement feature has a first triangular shape when viewed normal to the vertical direction, the third slot having the first triangular shape.

3. The child-resistant container of claim 2, wherein the fourth engagement feature has a second triangular shape when viewed normal to the vertical direction, the fourth slot having the first triangular shape.

4. The child-resistant container of claim 3, wherein the first engagement feature is disposed opposite the second engagement feature.

5. The child-resistant container of claim 4, wherein the third engagement feature is disposed opposite the fourth engagement feature.

6. The child-resistant container of claim 2, wherein the first, second, third, and fourth engagement features each include an upper horizontal surface configured to engage with the ledge in the locked configuration.

* * * * *